United States Patent [19]

Stephens

[11] 4,004,786

[45] Jan. 25, 1977

[54] STIRRING DEVICE

[75] Inventor: Will R. Stephens, Cedar Rapids, Iowa

[73] Assignee: Barnard & Leas Manufacturing Co. Inc., Cedar Rapids, Iowa

[22] Filed: May 16, 1975

[21] Appl. No.: 578,104

[52] U.S. Cl. ..... 259/107; 416/199; 416/203

[51] Int. Cl.[2] ..... B01F 7/00

[58] Field of Search ..... 259/107, 108, 8, 23, 259/24, 43, 44, 66, 67; 416/175, 184, 199, 203, 228

[56] References Cited

UNITED STATES PATENTS

| | | | |
|---|---|---|---|
| 219,945 | 9/1879 | Hogan | 416/199 |
| 695,974 | 3/1902 | Wallerstein et al. | 259/107 |
| 2,139,871 | 12/1938 | Wilson et al. | 259/107 |
| 2,193,686 | 3/1940 | Craddock | 416/228 |
| 2,626,889 | 1/1953 | Carney | 259/107 |

*Primary Examiner*—Henry K. Artis
*Assistant Examiner*—John W. Shepperd
*Attorney, Agent, or Firm*—McDougall, Hersh & Scott

[57] ABSTRACT

A stirring device is disclosed for mixing liquid and dry ingredients in a tank. The stirring device employs an agitator prop having claws or fingers formed thereon to break up balls of dry ingredients, a shear plate to strain and shear ingredients forced therethrough by operation of the agitator prop and a pump prop. The agitator and pump props have reverse pitches with respect to each other such that both props push the ingredients toward the shear plate.

3 Claims, 4 Drawing Figures

STIRRING DEVICE

BACKGROUND OF THE INVENTION

This invention is in the field of unit operations and it relates more particularly to chemical process equipment for commercial use in effecting rapid and complete solution or suspension of materials into a liquid system.

In particular, the invention relates to mixing devices for the preparation of animal feed and fertilizer in liquid form. Such products are formed from quantities of liquid chemicals, a small percentage of dry ingredients, and various additives such as attapulgite clay which acts as a suspension agent to produce a granular slurry in which the various ingredients are suspended. The production of such slurries is hindered by the tendency of the ingredients, particularly the dry powdered clay, to ball up during mixing. Such agglomerations remain in the final product and reduce the consistency and quality of the final product.

It is an object of this invention to provide a new and improved piece of stirring equipment for chemical processes wherein materials are to be taken into solution, and it relates more particularly to equipment which is adapted for achieving rapid and complete mixing, which is simple in construction and efficient in operation, which effects solution and suspension at a faster rate than equipment now available, which provides homogenization for uniform distribution of the materials in the solution and suspension and which avoids entrainment of foreign materials such as air.

These and other objects and advantages of this invention will hereafter appear.

DETAILED DESCRIPTION

Figure 1:
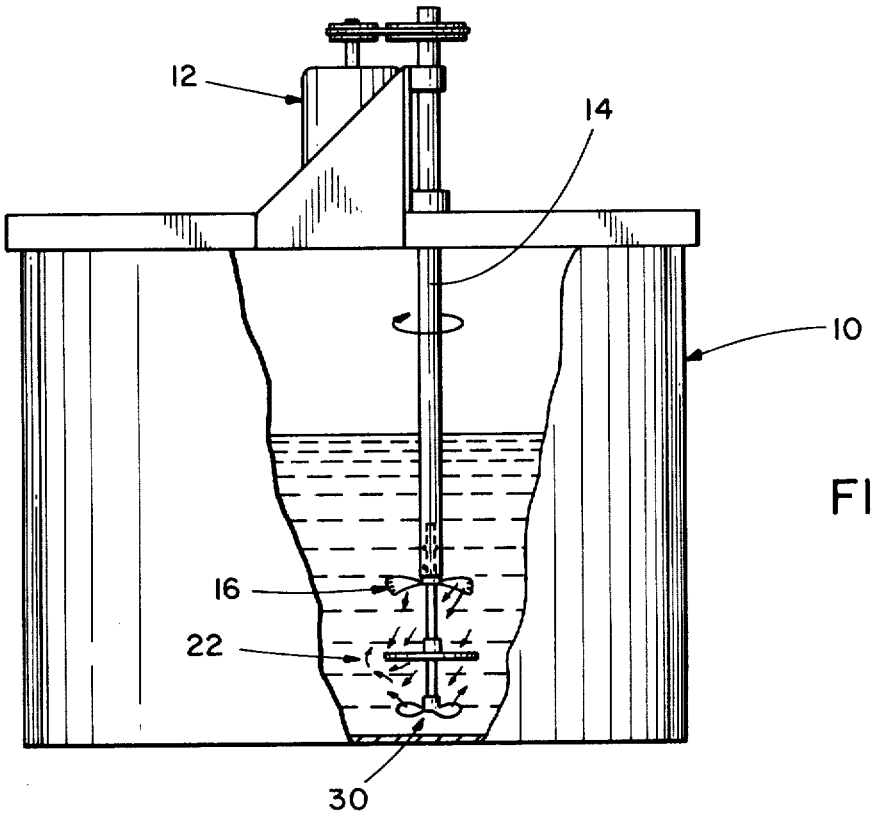
FIG. 1 is a front elevation of a mixing tank having portions cut away to illustrate the positioning of a stirring device according to the present invention therein.

Referring to FIG. 1, a mixing tank 10 has mounted at the top thereof a motor and pulley arrangement 12 of conventional design adapted to drive a stirring shaft 14. The stirring device according to the present invention is affixed to the lower end of shaft 14 by means of set screws in a manner to be described.

The stirring device comprises three separate elements which operate in conjunction with each other to produce an agitation or stirring effect heretofore unavailable. These elements produce not only a stirring of the ingredients but claw, tear, shred and shear the ingredients to thoroughly mix them.

Figure 2:
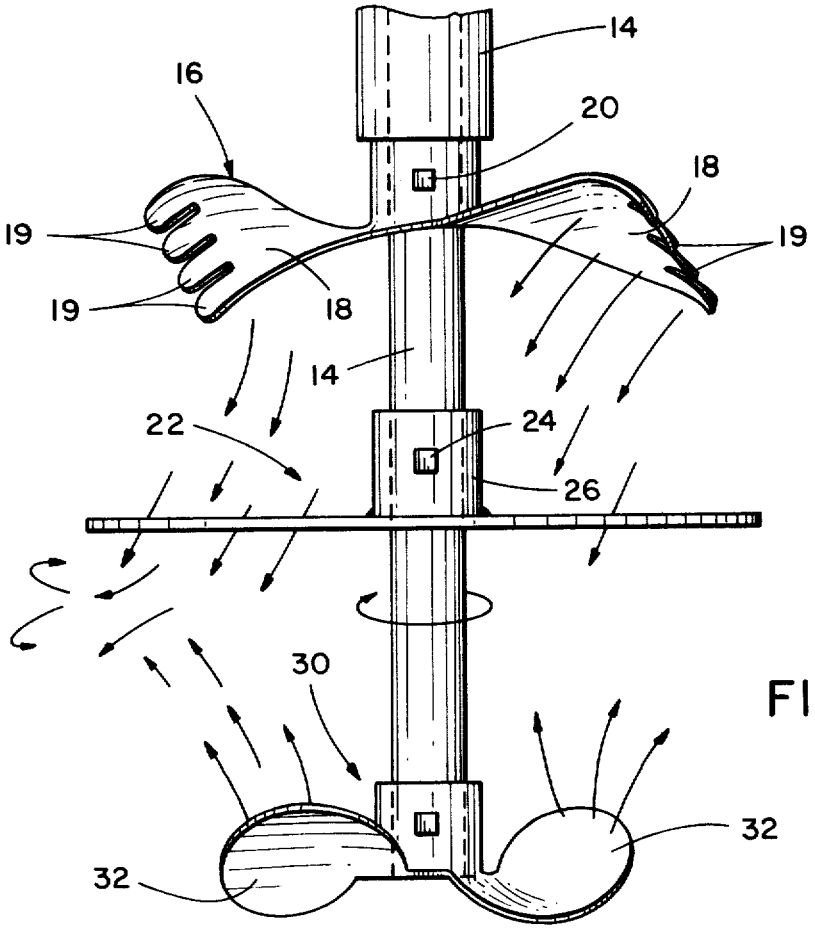
FIG. 2 is a front elevation on a larger scale of the stirring device according to the present invention.
Figure 3:
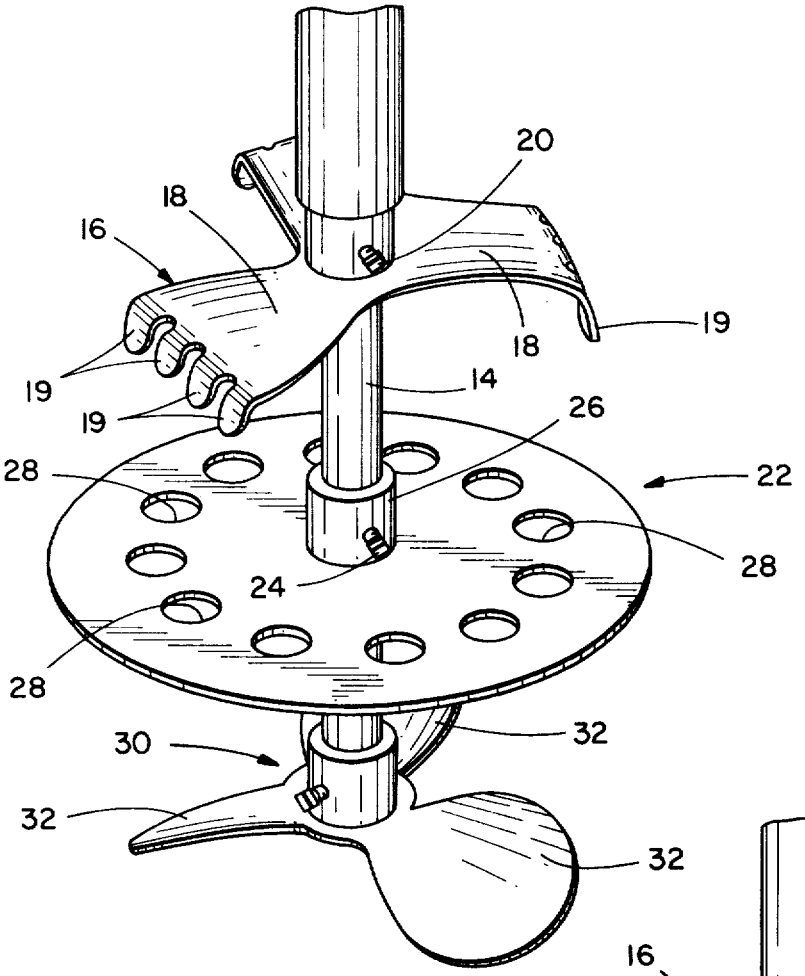
FIG. 3 is a top perspective view of the stirring device.
Figure 4:
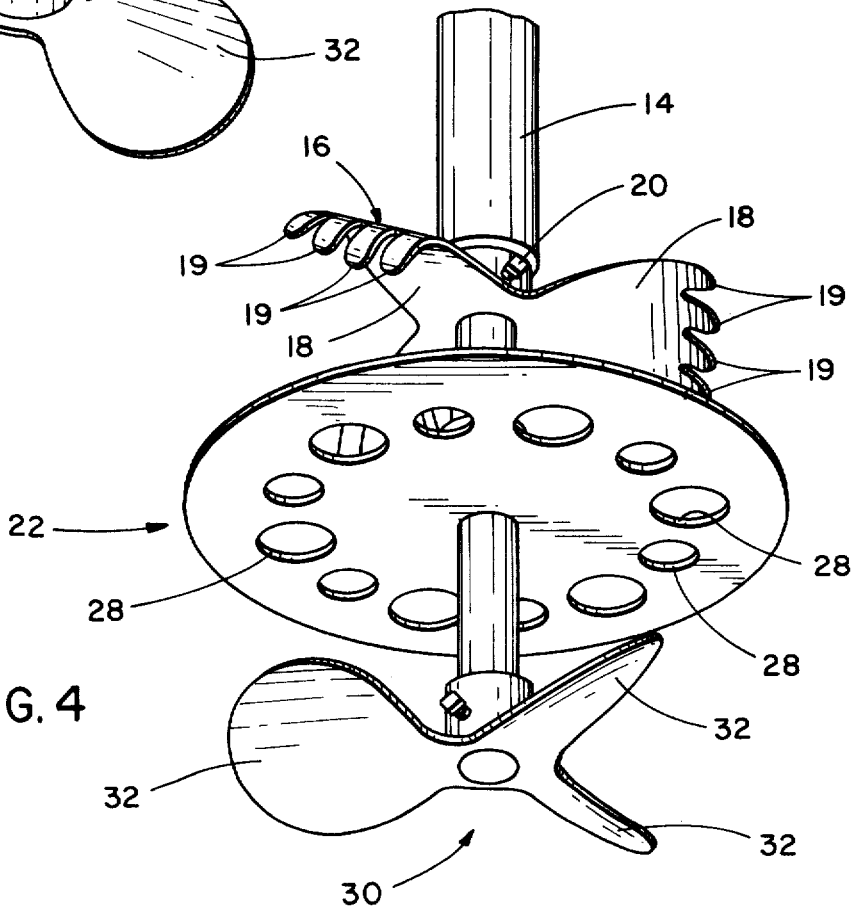
FIG. 4 is a bottom perspective view of the stirring device.

As best seen in FIGS. 2–4, the elements of the stirring device comprise an agitator prop 16 having two or more blades 18 thereon. In the embodiment illustrated, the prop is shown with three such blades. Located on the ends of each blade 18 are a plurality of fingers 19 extending outwardly therefrom. Agitator prop 16 is secured to the shaft 14 by a set screw 20 and thus can be repositioned or removed if damaged.

The second element of the stirring device is a shear plate 22 similarly secured to the shaft by a set screw 24 provided in the shear plate collar 26. The shear plate, as illustrated in FIGS. 3 and 4, is circular and has a plurality of openings 28 through its surface. Preferably these openings are spaced around the shear plate equidistant from the center. The number, spacing and size of the openings in the shear plate of course can be varied as desired.

The final element of the stirring device is a pumping propellor 30 also secured to the shaft 14 by a set screw. The pumping propellor has at least two and preferably three or more blades 32 thereon.

Considering the basic operation of the stirring device it should first be noted that the blades of the agitator prop 16 have a left-handed pitch, while the blades of the pumping prop 30 have a right-handed pitch. Thus, it will be apparent that during rotation of shaft 14 in the indicated direction the two props oppose one another; that is, ingredients above the shear plate 22 are directed downwardly by the action of the agitator prop 16 while materials below the shear plate are directed upwardly against it by the pumping prop 30. This feature of the invention which continually directs the materials to be mixed toward the shear plate provides a substantial improvement over prior art devices.

The purpose of the agitator prop 16 aside from its function of directing the materials to be mixed toward the shear plate is to shear and provide violent agitation to break up ingredients which ball up and, in particular, the dry powdered clay utilized for producing liquid fertilizer suspensions. The fingers 19 of the blade 18 produce a suitable agitation for this purpose.

The shear plate 22 acts to strain and shear ingredients forced through the holes 28 due to its high speed rotation. This action of the shear plate effects a reduction in the size of any lumps or balls of unmixed material. The openings in the shear plate may or may not be equally spaced around the surface and may also vary in diameter.

The pump prop 30 provides the stated reversing action to pump the material back up against the shear plate after it has been forced downwardly through the shear plate openings by the agitator prop 16. This creates a desirable controlled vortex condition, assuring a thorough mixing and blending of all the ingredients.

Depending upon the application, 15–75 HP motors have been found more than adequate to drive a shaft having the stirring device of the present invention mounted thereon. In a typical operation where a liquid fertilizer slurry is being produced, water is normally added to the tank before activating the stirring device of the present invention. The other ingredients are then added while the stirring device remains in operation to effect the necessary mixing of the ingredients.

While I have shown and described embodiments of this invention in some detail, it will be understood that this description and accompanying illustrations are offered merely by way of example, and that the invention is to be limited in scope only by the appended claims.

I claim:

1. A stirring device for mixing ingredients in a tank comprising:

($a_1$) a tank, a. a motor, b. a shaft extending into said tank and mounted for rotational movement about a vertical axis, c. a horizontally disposed circular shear plate mounted for rotation with said shaft, said plate having a plurality of openings for shearing ingredients forced therethrough, d. a first prop mounted for rotation with said shaft above and spaced from said shear plate having at least two blades pitched from the horizontal to mix and propel said ingredients downwardly toward said shear plate and having a plurality of fingers extending outwardly from the ends of the blades in a direction toward the shear plate, e. a second prop mounted for rotation with said shaft below and spaced from said shear plate having at least two pump blades pitched from the horizontal in the direction opposite to the pitch of the blades of the first prop to mix and propel said ingredients upwardly toward said shear plate, whereby the combined actions of the first and second props produce a vortex condition in the vicinity of the rotating shear plate for thorough mixing.

2. The device of claim 1 wherein said openings in said plate are circular openings of different diameters.

3. The device according to claim 1 wherein said openings are spaced equidistant from the center of said circular plate.

* * * * *